US006402341B1

(12) United States Patent
Onate

(10) Patent No.: US 6,402,341 B1
(45) Date of Patent: Jun. 11, 2002

(54) DECORATIVE ORNAMENTAL ASSEMBLY

(76) Inventor: Laura M. Onate, 1415 Custoza Ave., Rowland Heights, CA (US) 91748

( * ) Notice: Subject to any disclaimer, the term of this patent is extended or adjusted under 35 U.S.C. 154(b) by 0 days.

(21) Appl. No.: 09/770,629

(22) Filed: Jan. 26, 2001

(51) Int. Cl.[7] ..... F21V 21/00
(52) U.S. Cl. ..... 362/249; 362/122; 362/806
(58) Field of Search ..... 362/122, 123, 362/226, 249, 252, 392, 396, 805, 806, 810, 391; 428/15, 17, 23, 24, 26

(56) References Cited

U.S. PATENT DOCUMENTS

| | | | | |
|---|---|---|---|---|
| 1,440,589 A | | 1/1923 | Elender | |
| 1,921,614 A | | 8/1933 | Frei, Jr. | |
| 1,938,736 A | | 12/1933 | Berman | |
| 3,050,619 A | * | 8/1962 | Bramson | 362/122 |
| 3,146,955 A | | 9/1964 | Sabuco | |
| 3,619,598 A | * | 11/1971 | Hermanson | 362/252 |
| 4,171,754 A | | 12/1979 | Rosado | |
| 4,590,545 A | * | 5/1986 | Scheer | 362/392 |
| 4,931,775 A | | 6/1990 | Sheriff | |
| D316,307 S | | 4/1991 | Harris et al. | |
| D319,705 S | | 9/1991 | Tsai | |
| 5,063,485 A | | 11/1991 | Harris | |

* cited by examiner

*Primary Examiner*—Y. My Quach-Lee

(57) ABSTRACT

A decorative ornamental assembly for providing easy to use and colorful decorations about Christmas trees and on building structures. The decorative ornamental assembly includes a pot assembly including pot members each having bottom and side walls and each also having an open top; and also includes a light-emitting assembly including candle-like light members being securely disposed in the pot members and extending through the tops of the pot members; and further includes poinsettia-like ornaments being disposed upon the pot members; and also includes support structures being attached to the pot members.

16 Claims, 2 Drawing Sheets

DECORATIVE ORNAMENTAL ASSEMBLY

BACKGROUND OF THE INVENTION

1. Field of the Invention

The present invention relates to poinsettia-like ornaments and more particularly pertains to a new decorative ornamental assembly for providing easy to use and colorful decorations about Christmas trees and on building structures.

2. Description of the Prior Art

The use of poinsettia-like ornaments is known in the prior art. More specifically, poinsettia-like ornaments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,938,736; U.S. Pat. No. 5,063,485; U.S. Pat. No. 4,171,754; U.S. Pat. No. 3,146,955; U.S. Pat. No. 1,440,589; U.S. Pat. No. 1,921,614; U.S. Pat. No. Des. 316,307; U.S. Pat. No. Des. 319,705; and U.S. Pat. No. 4,931,775.

While these devices fulfill their respective, particular objectives and requirements the aforementioned patents do not disclose a new decorative ornamental assembly. The inventive device includes a pot assembly including pot members each having bottom and side walls and each also having an open top; and also includes a light-emitting assembly including candle-like light members being securely disposed in the pot members and extending through the tops of the pot members; and further includes poinsettia-like ornaments being disposed upon the pot members; and also includes support structures being attached to the pot members.

In these respects, the decorative ornamental assembly according to the present invention substantially departs from the conventional concepts and designs of the prior art and in so doing provides an apparatus primarily developed for the purpose of providing easy to use and colorful decorations about Christmas trees and on building structures.

SUMMARY OF THE INVENTION

In view of the foregoing disadvantages inherent in the known types of poinsettia-like ornaments now present in the prior art, the present invention provides a new decorative ornamental assembly construction wherein the same can be utilized for providing easy to use and colorful decorations about Christmas trees and on building structures.

The general purpose of the present invention, which will be described subsequently in greater detail, is to provide a new decorative ornamental assembly which has many of the advantages of the poinsettia-like ornaments mentioned heretofore and many novel features that result in a new decorative ornamental assembly which is not anticipated, rendered obvious, suggested, or even implied by any of the prior art poinsettia-like ornaments, either alone or in any combination thereof.

To attain this, the present invention generally comprises a pot assembly including pot members each having bottom and side walls and each also having an open top; and also includes a light-emitting assembly including candle-like light members being securely disposed in the pot members and extending through the tops of the pot members; and further includes poinsettia-like ornaments being disposed upon the pot members; and also includes support structures being attached to the pot members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new decorative ornamental assembly which has many of the advantages of the poinsettia-like ornaments mentioned heretofore and many novel features that result in a new decorative ornamental assembly which is not anticipated, rendered obvious, suggested, or even implied by any of the prior art poinsettia-like ornaments, either alone or in any combination thereof.

It is another object of the present invention to provide a new decorative ornamental assembly which may be easily and efficiently manufactured and marketed.

It is a further object of the present invention to provide a new decorative ornamental assembly which is of a durable and reliable construction.

An even further object of the present invention is to provide a new decorative ornamental assembly which is susceptible of a low cost of manufacture with regard to both materials and labor, and which accordingly is then susceptible of low prices of sale to the consuming public, thereby making such decorative ornamental assembly economically available to the buying public.

Still yet another object of the present invention is to provide a new decorative ornamental assembly which provides in the apparatuses and methods of the prior art some of the advantages thereof, while simultaneously overcoming some of the disadvantages normally associated therewith.

Still another object of the present invention is to provide a new decorative ornamental assembly for providing easy to use and colorful decorations about Christmas trees and on building structures.

Yet another object of the present invention is to provide a new decorative ornamental assembly which includes a pot assembly including pot members each having bottom and side walls and each also having an open top; and also includes a light-emitting assembly including candle-like light members being securely disposed in the pot members and extending through the tops of the pot members; and further includes poinsettia-like ornaments being disposed upon the pot members; and also includes support structures being attached to the pot members.

Still yet another object of the present invention is to provide a new decorative ornamental assembly that provides a novel ornamental appearance.

Even still another object of the present invention is to provide a new decorative ornamental assembly that resemble life-like potted poinsettias.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
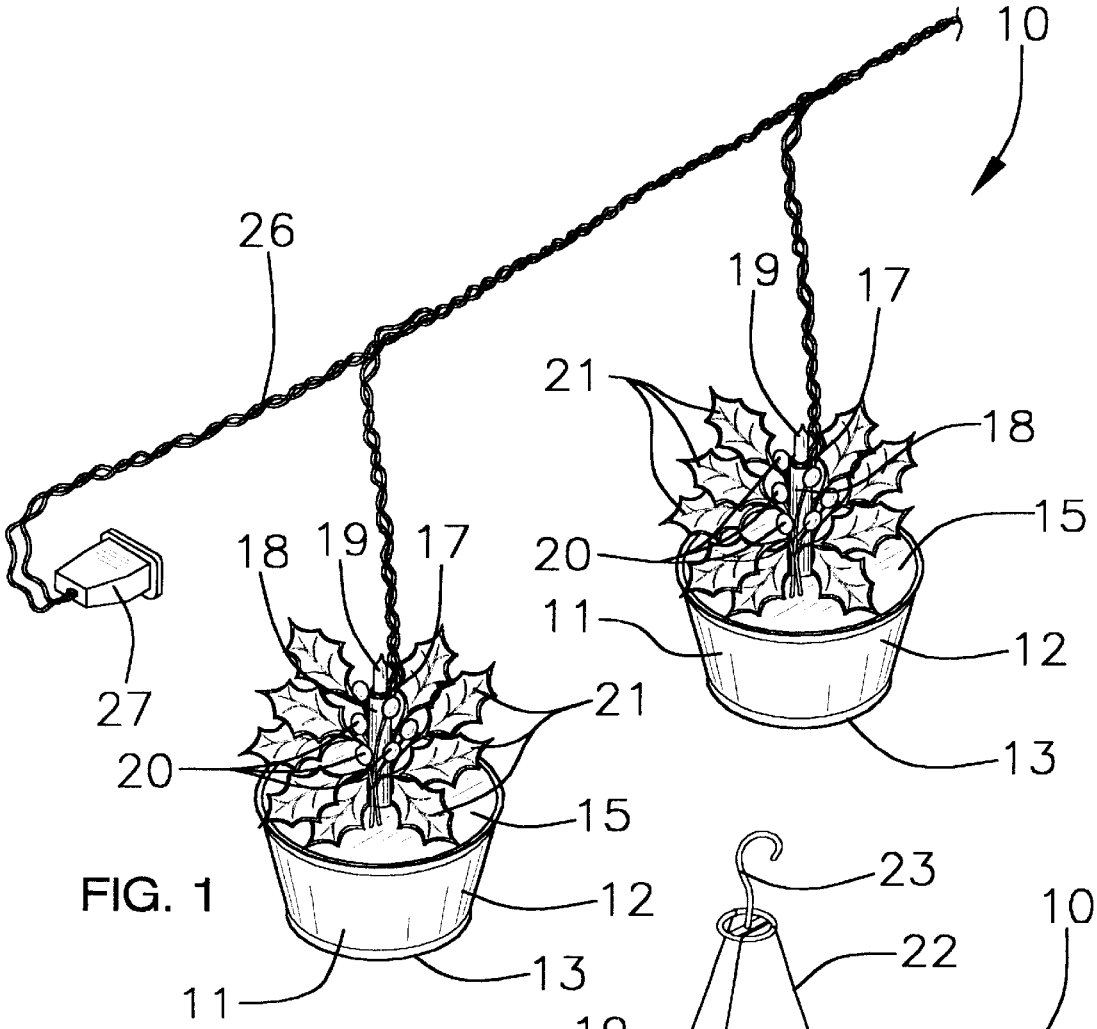
FIG. 1 is a perspective view of a first embodiment of a new decorative ornamental assembly according to the present invention.
Figure 2:
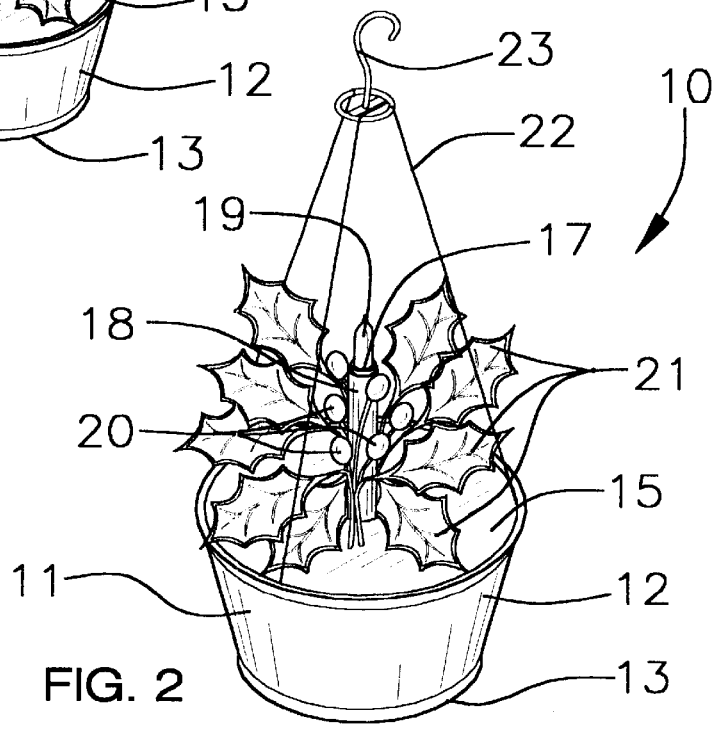
FIG. 2 is a perspective view of a second embodiment of the present invention.
Figure 3:
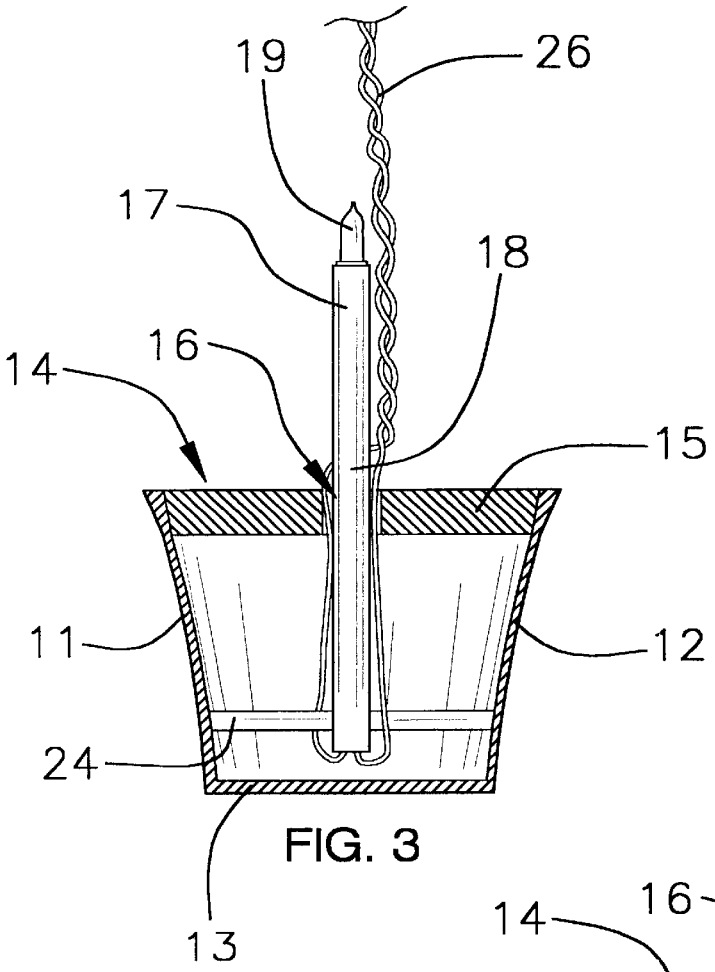
FIG. 3 is a cross-sectional view of the pot member and candle-like light-emitting member of the first embodiment of the resent invention.
Figure 4:
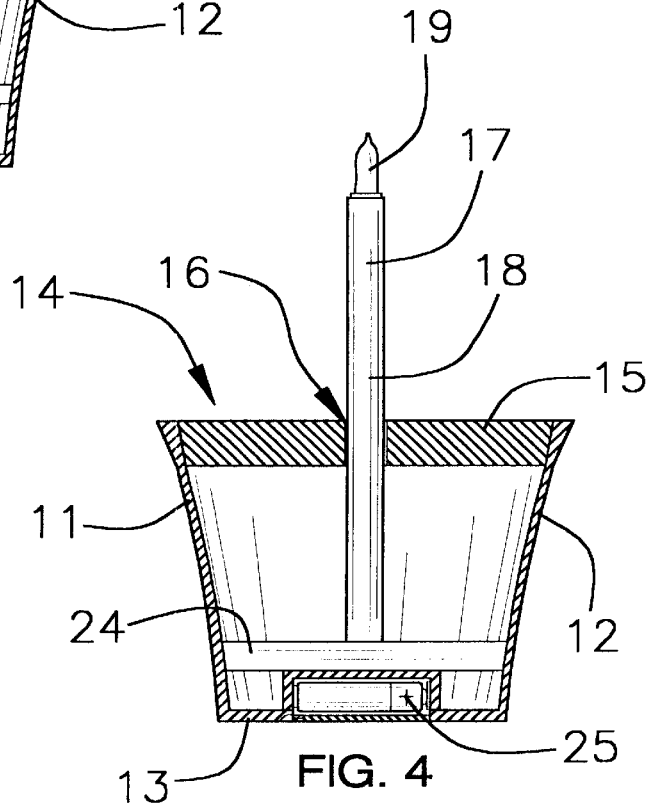
FIG. 4 is a cross-sectional view of the pot member and the candle-like light-emitting member of the second embodiment of the resent invention.

With reference now to the drawings, and in particular to FIGS. 1 through 4 thereof, a new decorative ornamental assembly embodying the principles and concepts of the present invention and generally designated by the reference numeral 10 will be described.

As best illustrated in FIGS. 1 through 4, the decorative ornamental assembly 10 generally comprises a pot assembly including pot members 11 each having bottom and side walls 12,13, and each also having an open top 14. The pot assembly further includes cover members 15 each being securely and conventionally disposed upon the open top 14 of a respective the pot member 11 and each having an opening 16 being centrally-disposed therethrough.

A light-emitting assembly includes candle-like light members 17 being securely and conventionally disposed in the pot members 11 and extending through the tops 14 of the pot members 11. The light-emitting assembly further includes elongate support members 24 being conventionally disposed in the pot members 11 and being securely and conventionally attached to the side walls 12 of the pot members 11, and also includes a plurality of light-emitting members 20 being disposed upon the cover members 15. Each of the candle-like light members 17 includes a shaft 18 having a top end and a bottom end which is securely attached to a respective elongate support member 24, and also includes a flame-shaped light-emitting member 19 being conventionally disposed upon the top end of the shaft 18 with the shaft 18 being disposed through the centrally-disposed opening 16 of a respective cover member 15. Poinsettia-like ornaments 21 are conventionally disposed upon the pot members 11 with the poinsettia-like ornaments 21 including artificial leaves and petals 21 being disposed upon the cover members 15 and with the artificial leaves and petals 21 being made of nylon material. Support structures 22,23,26,27 are conventionally attached to the pot members 11.

As a first embodiment, the support structures 26,27, include electrical cords 26 having plug-receiving members 27 being conventionally disposed at end thereof and being securely and conventionally connected to the candle-like light members 17 and to the light-emitting members 20.

As a second embodiment, the support structures 22,23, include hanger members 22 being conventionally attached to the pot members 11 and having hook members 23 for suspending upon Christmas trees. The light-emitting assembly further includes battery packs 25 being removably disposed in the pot members 11 and being disposed through and upon the bottom walls 13 of the pot members 11 and being conventionally connected to the candle-like light members 17 and to the light-emitting members 20.

In use, the user hangs the pot members 11 upon walls of building structures or upon Christmas trees to provide a unique ornamental appearance.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative ornamental assembly comprising:

a pot assembly including pot members each having a bottom wall and a side wall and each also having an open top;

a light-emitting assembly including light members being securely disposed in said pot members and extending through said tops of said pot members;

ornaments being disposed upon said pot members; and support structures being attached to said pot members;

wherein said pot assembly further includes cover members each being securely disposed upon said open top of a respective said pot member and each having an opening being centrally-disposed therethrough;

wherein said light-emitting assembly further includes elongate support members being disposed in said pot members and being securely attached to said side wall of said pot members, for supporting said light-member and also includes a plurality of light-emitting members being disposed upon each of said cover members.

2. A decorative ornamental assembly as described in claim 1, wherein each of said light members includes a shaft having a top end and a bottom end which is securely attached to a respective said elongate support member, and also includes a flame-shaped light-emitting member being disposed upon said top end of said shaft, said shaft being disposed through said centrally-disposed opening of a respective said cover member.

3. A decorative ornamental assembly as described in claim 1, wherein said ornaments include artificial leaves and petals being disposed upon said cover members, said artificial leaves and petals being made of nylon material.

4. A decorative ornamental assembly as described in claim 1, wherein said support structures include hanger members being attached to said pot members and having hook members for suspending upon Christmas trees.

5. A decorative ornamental assembly as described in claim 1, wherein said light-emitting assembly further includes a battery pack being removably disposed in at least one of said pot members and being disposed through and upon said bottom walls of said pot member and being electrically connected to said light member and to said light-emitting members.

6. A decorative ornamental assembly as described in claim 1, wherein said support structures include electrical cords having plug-receiving members being disposed at end thereof and being securely connected to said light members and to said light-emitting members.

7. A decorative ornamental assembly comprising:

a pot assembly including pot members each having a bottom wall and a side wall and each also having an open top, said pot assembly further including cover members each being securely disposed upon said open top of a respective said pot member and each having an opening being centrally-disposed therethrough;

a light-emitting assembly including light members being securely disposed in said pot members and extending through said tops of said pot members, said light-emitting assembly further including elongate support members being disposed in said pot members and being securely attached to said side walls of said pot members, and also including a plurality of light-emitting members being disposed upon each of said cover members, each of said members including a shaft having a top end and a bottom end which is securely attached to a respective said elongate support member, and also including a flame-shaped light-emitting member being disposed upon said top end of said shaft, said shaft being disposed through said centrally-disposed opening of a respective said cover member;

ornaments being disposed upon said pot members, said ornaments including artificial leaves and petals being disposed upon said cover members, said artificial leaves and petals being made of nylon material; and support structures being attached to said pot members.

8. A decorative ornamental assembly as described in claim 7, wherein said support structures include hanger members being attached to said pot members and having hook members for suspending upon Christmas trees, said light-emitting assembly further including a battery pack being removably disposed in at least one of said pot members and being disposed through and upon said bottom wall of said pot member and being electrically connected to said light member and to said light-emitting members.

9. A decorative ornamental assembly as described in claim 8, wherein said support structures include electrical cords having plug-receiving members being disposed at ends thereof and being securely connected to said light members and to said light-emitting members.

10. A decorative ornamental assembly comprising:

a pot assembly including cover member connected to pot members each of said pot member having a bottom wall and a side wall and each also having an open top;

a light-emitting assembly including light members being securely disposed in said pot members and extending through said tops of said pot members and said cover member;

ornaments being disposed upon said pot members; and support structures being attached to said pot members;

wherein said light-emitting assembly further includes elongate support members being disposed in said pot members and being securely attached to said side walls of said pot members for supporting said light-member, and also includes a plurality of light-emitting members being disposed upon each of said cover members.

11. A decorative ornamental assembly as described in claim 10, wherein each of said cover members disposed upon said open top of a respective said pot member and each having an opening being centrally-disposed therethrough.

12. A decorative ornamental assembly as described in claim 11, wherein each of said light members includes a shaft having a top end and a bottom end which is attached to a respective said elongate support member, and also includes a flame-shaped light-emitting member being disposed upon said top end of said shaft, said shaft being disposed through said centrally-disposed opening of a respective said cover member.

13. A decorative ornamental assembly as described in claim 10, wherein said ornaments include artificial leaves and petals being disposed upon said cover members, said artificial leaves and petals being, made of nylon material.

14. A decorative ornamental assembly as described in claim 10, wherein said support structures include hanger members being attached to said pot members and having hook members for suspending upon Christmas trees.

15. A decorative ornamental assembly as described in claim 10, wherein said light-emitting assembly further includes a battery pack being removably disposed in at least one of said pot members and being disposed through and upon said bottom wall of said pot member and being electrically connected to said light member and to said light-emitting members.

16. A decorative ornamental assembly as described in claim 10, wherein said support structures include electrical cords having plug-receiving members being disposed at end thereof and being connected to said light members and to said light-emitting members.

* * * * *